United States Patent [19]

Foglesonger et al.

[11] Patent Number: 4,689,876

[45] Date of Patent: Sep. 1, 1987

[54] METHOD OF MAKING WAVEGUIDE ASSEMBLY

[75] Inventors: John D. Foglesonger, Los Angeles; David M. Vranson, Canyon Country, both of Calif.

[73] Assignee: ITT Gilfillan, a division of ITT Corporation, Van Nuys, Calif.

[21] Appl. No.: 892,565

[22] Filed: Aug. 4, 1986

Related U.S. Application Data

[62] Division of Ser. No. 631,425, Jul. 16, 1984, Pat. No. 4,638,273.

[51] Int. Cl.[4] ..... H01P 11/00

[52] U.S. Cl. ..... 29/600

[58] Field of Search ..... 29/600, 458, 463; 156/156, 245, 581; 333/254, 255; 285/414, 915

[56] References Cited

U.S. PATENT DOCUMENTS

| | | | |
|---|---|---|---|
| 2,684,775 | 7/1954 | Van Hofe | 156/581 X |
| 2,768,920 | 10/1956 | Stout | 156/192 X |
| 3,343,252 | 9/1967 | Reesor | 285/915 X |
| 3,500,264 | 3/1970 | Floyd, Jr. | 333/254 |
| 3,942,141 | 3/1976 | Kaffenberger | 333/259 |
| 4,150,848 | 4/1979 | Dyrup | 285/414 X |

FOREIGN PATENT DOCUMENTS

| | | | |
|---|---|---|---|
| 2947245 | 6/1981 | Fed. Rep. of Germany | 29/600 |

*Primary Examiner*—Howard N. Goldberg
*Assistant Examiner*—Carl J. Arbes
*Attorney, Agent, or Firm*—Robert A. Walsh; Mary C. Werner

[57] ABSTRACT

A waveguide joint with flanges bonded to a waveguide section. Each flange is divided into two pieces with internal knurling and corner projections to bite into the external waveguide corners. The flange pieces are pressed on while the bonding adhesive is cured.

8 Claims, 9 Drawing Figures

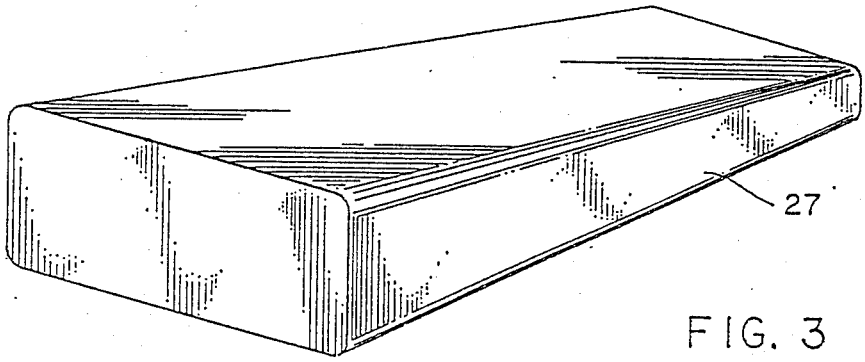
FIG. 3
FIG. 4
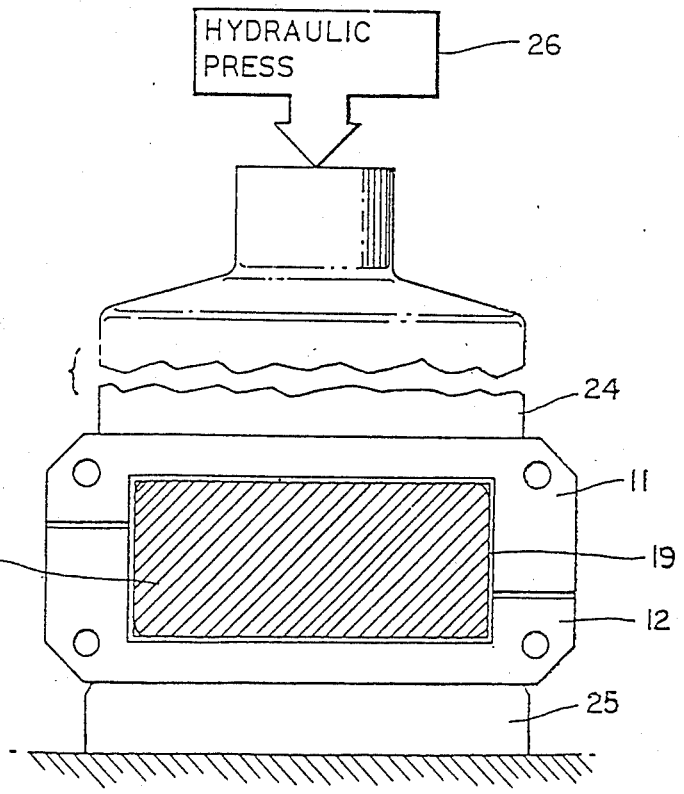

METHOD OF MAKING WAVEGUIDE ASSEMBLY

This application is a divisional application of my copending application Ser. No. 631,425 filed on July 16, 1984 now U.S. Pat. No. 4,638,273 issued Jan. 20, 1987.

BACKGROUND OF THE INVENTION

1. Field of the Invention

This invention relates to waveguide constructions, and more particularly to a waveguide joint and to a method of making the same.

2. Description of the Prior Art

In the past, it has been the practice to bond flanges to sections of waveguide by dip brazing. This has caused waveguide corrosion and loss of dimensions.

SUMMARY OF THE INVENTION

In accordance with the present invention, there is provided a waveguide joint having flanges bonded thereto with a cold or moderately warmly cured adhesive. Structural strength is provided in other ways. The corrosion and loss of dimensions in the prior art dip brazing are thus avoided.

BRIEF DESCRIPTION OF THE DRAWINGS

In the accompanying drawings which illustrate exemplary embodiments of the present invention:

FIG. 3 is a perspective view of a mandrel;

FIG. 4 is a side elevational view of a hydraulic press with a mandrel in cross section for forming the waveguide joint;

DESCRIPTION OF THE PREFERRED EMBODIMENT

Figure 1:
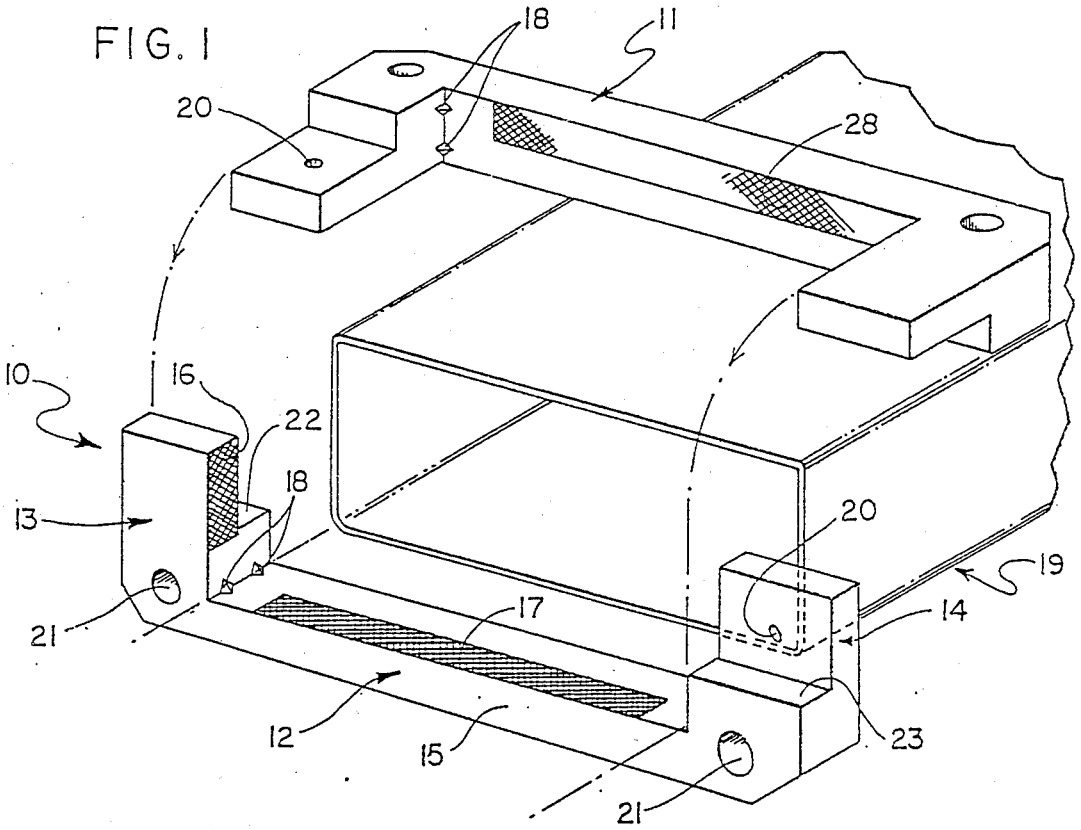
FIG. 1 is a perspective view of some component parts of the waveguide joint of the present invention.
Figure 7:
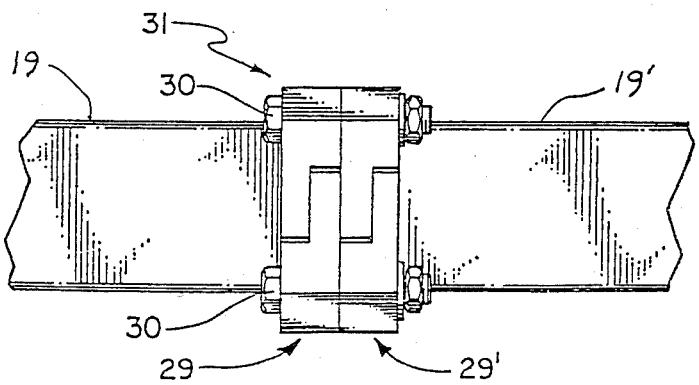
FIG. 7 is a side elevational view of a waveguide joint constructed in accordance with the present invention.

In the drawings, in FIG. 1 enough parts are shown to make one subassembly, two of which are required to make a complete waveguide joint (FIG. 7).

In FIG. 1, a flange 10 is provided in two pieces 11 and 12. If desired, pieces 11 and 12 may be identical. Thus, only piece 12 will be described in detail.

Piece 12 is U-shaped having legs 13 and 14, and a bight portion 15.

Leg 13 is knurled at 16. Leg 14 is not knurled at all. Bight portion 15 is knurled at 17.

Each piece 11 and 12 has four projections 18 in the internal corners thereof.

The knurled surfaces 16 and 17 on both pieces 11 and 12 are pressed with an adhesive against the exterior of a waveguide section 19 for strength and provide a gas tight seal.

Figure 8:
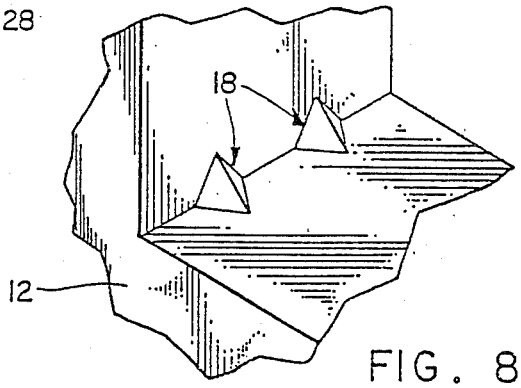
FIG 8 is an enlarged perspective view of a partly broken away flange.

Projections 18 (see also FIG. 8) bite into the exterior corners of waveguide section 19 to prevent energy leakage and/or to prevent gas leakage.

Guide holes are provided at 20 in FIG. 1 for insertion of pins after pressure is applied by mandrel 27 (FIG. 3) to fix the parts together.

Bolt holes are provided at 21 in FIG. 1.

Legs 13 and 14 have stepped portions 22 and 23, respectively.

Figure 2:
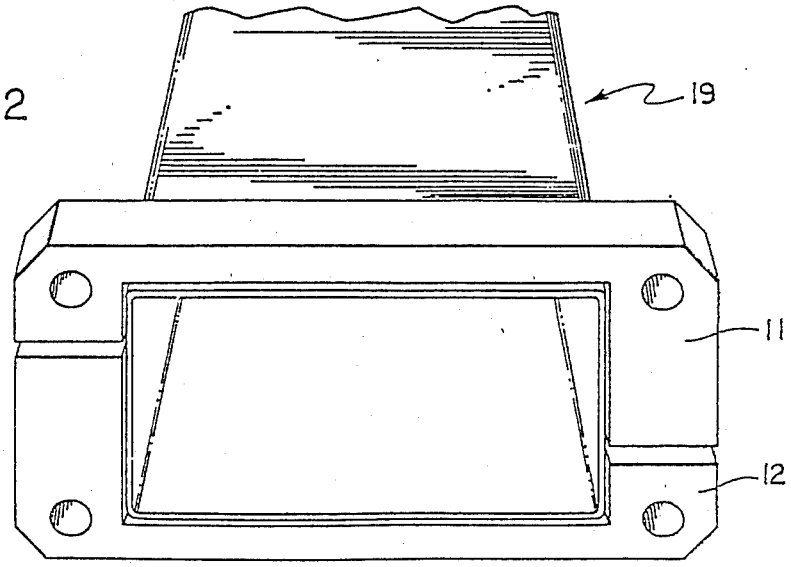
FIG. 2 is a perspective view of the parts of FIG. 1 partly assembled.

Before pressure is applied, pieces 11 and 12 may generally be fitted in the positions shown in FIG. 2. Then, they are pressed together as illustrated in FIG. 4 in the jaws 24 and 25 of a hydraulic press 26, with a mandrel 27 located inside waveguide section 19. See also that mandrel 27 in FIG. 3 may be tapered in one or two dimensions.

Figure 6:
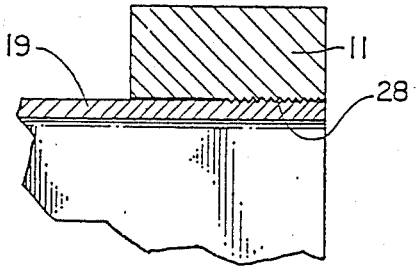
FIG. 6 is a broken away longitudinal sectional view taken on the line 6—6 shown in FIG. 5.

Adhesive 28 shown in FIG. 6.

Figure 5:
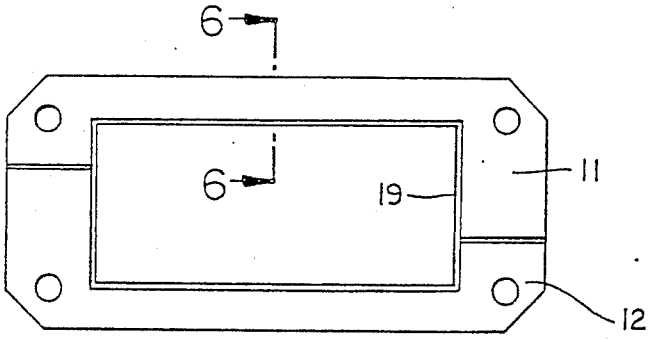
FIG. 5 is a side elevational view of a subassembly constructed in accordance with the present invention.

The parts shown in FIG. 5 may be called a subassembly 29. Subassembly 29 is shown bolted at 30 to an identical subassembly 29' in FIG. 7 to provide a waveguide joint 31.

Figure 9:
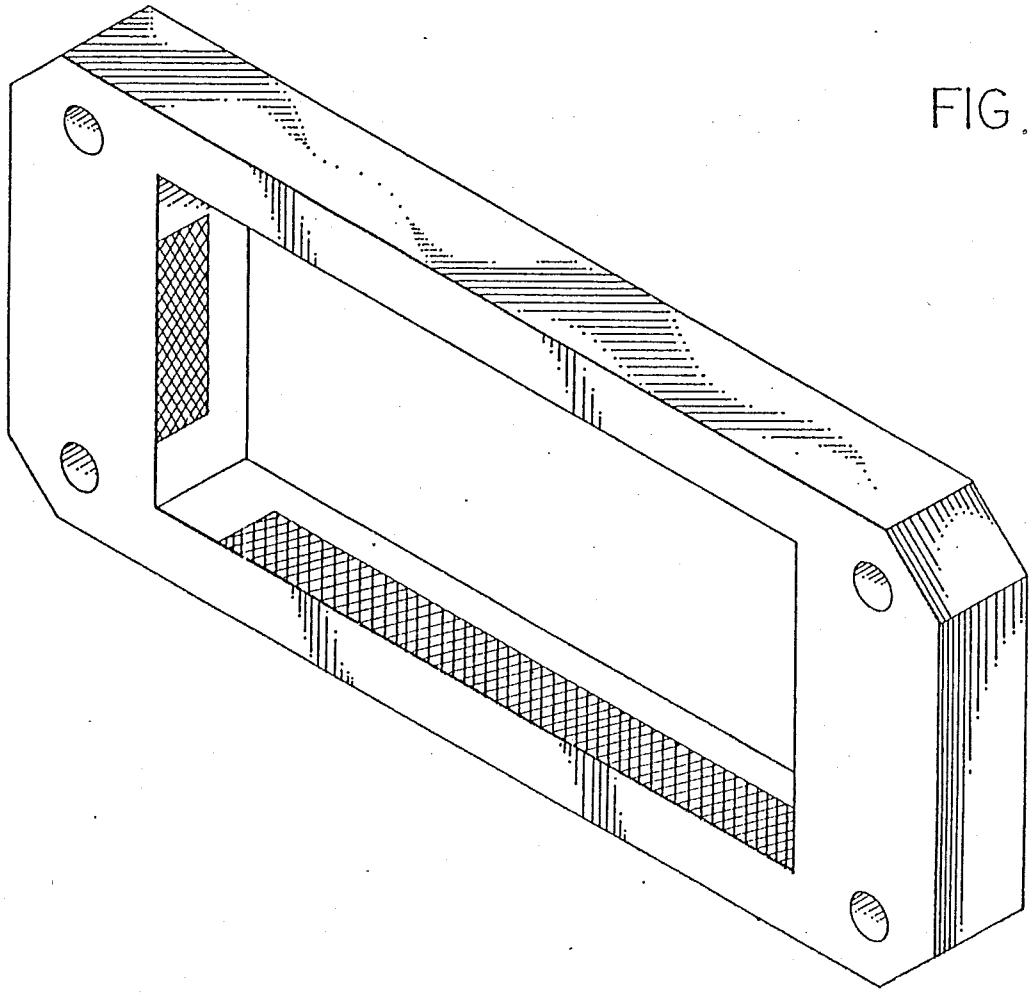
FIG. 9 is a perspective view of an alternative embodiment of the present invention.

An alternative flange is shown in FIG. 9 and consists of bonding material and knurling only, without corner projections. Registration and mandrel usage is as described above. This single piece configuration is used where added strength of corner projections is not required.

Although the present invention has been described in terms of the presently preferred embodiment(s), it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A method of making a subassembly for a waveguide joint, said method comprising the steps of:

providing a rectangular waveguide section having four sides forming four corners;

providing a flange separated into two pieces, said pieces having internal constructions for forced engagement with the exterior of said waveguide section;

placing an adhesive internally on said flange pieces;

inserting a mandrel into said waveguide section; and pressing said flange pieces onto said waveguide section while curing said adhesive.

2. The method of making a subassembly for a waveguide joint as recited in claim 1 further including the step of knurling portions of the internal surface of the two pieces of said flange for providing strength and a seal tight construction.

3. The method of making a subassembly for a waveguide joint as recited in claim 1 further including the step of providing a plurality of projections located in the internal corners of the two pieces of said flange for biting into the waveguide section exterior for providing construction strength and preventing energy and gas leakage.

4. The method of making a subassembly for a waveguide joint as recited in claim 1 further including the step of providing guideholes in the two pieces of said flange and inserting a pin through each of said guideholes for securing said subassembly.

5. The method of making a subassembly for a waveguide joint as recited in claim 1 further including the step of providing bolt holes in the two pieces of said flange and inserting a bolt through each of said bolt-holes for securing the two pieces of said flange to an identical flange for forming said waveguide joint.

6. A method of making a subassembly for a waveguide joint, said method comprising the steps of:

providing a rectangular waveguide section having four sides forming four corners;

providing a flange having four integral sides, said flange sides having internal constructions for forced engagement with the exterior of said waveguide section;

placing an adhesive internally on said flange sides;

inserting a mandrel into said waveguide section; and pressing said flange pieces onto said waveguide section while curing said adhesive.

7. The method of making a subassembly for a waveguide joint as recited in claim 6 further including the step of knurling portions of the internal surface of the four intergral sides of said flanges for providing strength and seal tight construction.

8. The method of making a subassembly for a waveguide joint as recited in claim 6 further including the step of providing bolt holes in said flange for accommodating a bolt for securing said flange to an identical flange for forming said waveguide joint.

* * * * *